United States Patent [19]

Hockett

[11] 4,255,906

[45] Mar. 17, 1981

[54] ABRASIVE CLEANING APPARATUS

[76] Inventor: Wayne B. Hockett, 1905 N. 43rd St., Tampa, Fla. 33605

[21] Appl. No.: 963,689

[22] Filed: Nov. 27, 1978

Related U.S. Application Data

[63] Continuation-in-part of Ser. No. 746,492, Dec. 1, 1976, Pat. No. 4,126,970, which is a continuation-in-part of Ser. No. 614,191, Sep. 16, 1975, Pat. No. 4,027,432.

[51] Int. Cl.[3] ..... B24C 3/06

[52] U.S. Cl. ..... 51/429; 239/255; 239/256

[58] Field of Search ..... 51/410, 427, 429, 439; 74/29, 30, 34; 118/315, 323; 239/536, 450, 160, 165, 166, 227, 252, 256, 255

[56] References Cited

U.S. PATENT DOCUMENTS

| | | | |
|---|---|---|---|
| 2,729,918 | 1/1956 | Van Denburgh | 51/429 |
| 3,548,541 | 12/1970 | Miller | 51/410 |
| 4,126,970 | 11/1978 | Hockett | 51/429 |

FOREIGN PATENT DOCUMENTS

| | | | |
|---|---|---|---|
| 733188 | 3/1943 | Fed. Rep. of Germany | 239/255 |
| 2312069 | 12/1976 | France | 74/29 |
| 7703359 | 10/1978 | Netherlands | 51/410 |

*Primary Examiner*—Gary L. Smith
*Attorney, Agent, or Firm*—Stein & Frijouf

[57] ABSTRACT

An abrasive cleaning apparatus is disclosed for cleaning a work surface by blasting the surface with an abrasive under fluid pressure from a remote source of abrasive and fluid. The apparatus comprises a base which is preferably mounted on a mobile chassis for supporting at least one nozzle by a nozzle support. A conduit connects the nozzle to the remote source of abrasive and fluid. The nozzle support is mounted to the base about a first axis of rotation. A second axis of rotation rotatably mounts the nozzle support for controlling the reaction force produced by the nozzle during operation. The first and second axis are established at an angle relative to one another such that a rotation of the nozzle about the second axis directs the reaction force of the nozzle during operation to cause rotation of the nozzle support about the first axis. An actuator alternately rotates the nozzle about the second axis when the nozzle reaches predetermined terminal positions about the first axis enabling automatic alternate sweeping across the work surface. The foregoing abstract is merely a resume of one general application, is not a complete discussion of all principles of operation or applications, and is not to be construed as a limitation on the scope of the claimed subject matter.

25 Claims, 16 Drawing Figures

ABRASIVE CLEANING APPARATUS

CROSS REFERENCE TO RELATED APPLICATIONS

This application is a continuation-in-part of Application Ser. No. 746,492 filed Dec. 1, 1976 now U.S. Pat. No. 4,126,970 which application is a continuation-in-part of my earlier filed application Ser. No. 614,191 filed Sept. 16, 1975 now U.S. Pat. No. 4,027,432.

BACKGROUND OF THE INVENTION

1. Field of the Invention

This invention relates to an abrasive cleaning apparatus and more particularly to an apparatus utilizing the reaction force of a cleaning nozzle to move the nozzle across a work surface.

2. Description of the Prior Art

The sand blasting of a surface prior to painting or simply cleaning as is in the case of stone or brick walls is a common practice. Generally this is accomplished by an operator positioned on a scaffold or other suitable support manually manipulating at least one discharge nozzle. Obviously the presence of the operator in this work zone makes this an extremely dirty and hazardous occupation. Moreover, the limited volume of sand blasted against the surface by a single nozzle is a very inefficient operation.

As a result, abrasive blasting apparati, particularly used for large surface areas, may employ multiple rather than a single blast nozzle. The obvious advantage of this being a greatly increased blast pattern. Due to the increased weight and speed of operation, multiple nozzles are often carried on a movable carriage or platform on which the operator rides. The platform is movable laterally and vertically along the area to be cleaned and results in significant labor saving devices.

Unfortunately, a number of difficulties have been experienced which hindered general acceptance and wide use for the multi-nozzle head. For example, many multi-nozzle head systems mix the sand and air in a common reservoir to discharge from the nozzles which communicate directly with the reservoir. In another configuration, the operator may be provided with two separate nozzles each having its own supply lines. In either of these arrangements, individual control of the nozzles is lacking to the extent that the blast stream in one nozzle cannot be cut off independently of the other. Such independent manipulations of the blast from the different nozzles is desirable in situations involving spots or areas which present a difficult cleaning problem. The blast from one nozzle must work on the difficult area for a prolonged period during which time other blasts will be damaging clean metal in the surrounding area.

Another difficulty with previous multi-blast carriage arrangements is that the units are very cumbersome and complex so as to be suitable only for special cleaning operations. Also many such multiple nozzle machines have lacked adequate flexibility of movement and could not be easily manipulated.

More unique problems exist with respect to the development of such apparatus for cleaning the undersides of ships in dry dock where there is very little clearance between the hull and the floor of the dry dock. Bulky machines cannot extend between the hull and the dry dock.

In my prior U.S. Pat. No. 4,027,433, I disclosed a sand blasting apparatus incorporating a plurality of nozzles mounted on an adjustable nozzle support. This patent has solved many of the needs as set forth in the prior art. In my subsequent U.S. Pat. No. 4,126,970, I utilized the multiple nozzles of my first patent and harnessed the reaction force produced by the plurality of nozzles to sweep the nozzles across a work surface. This device enabled an operator to control the movement of the nozzles about a first axis in accordance with the rotation of the nozzles about a second axis established at an angle relative to the first axis.

In the present invention, I have further improved my previous inventions to provide an apparatus which requires minimal physical manipulation by an operator. Accordingly, it is a primary object of this invention to provide an improved apparatus for cleaning a work surface by blasting the surface with an abrasive which overcomes the problems of the prior art and which improves upon my two prior inventions.

Another object of this invention is to provide an apparatus for cleaning a work surface by blasting the surface with an abrasive wherein an actuator rotates the abrasive cleaning nozzle about a second axis to control the reaction force of the nozzle, thereby enabling automatic alternate sweeping across the work surface about a first axis.

Another object of this invention is to provide an apparatus for cleaning a work surface by blasting surface with an abrasive including base drive means for linearly moving the base relative to the work surface upon alternate sweeps of the nozzle thereby coordinating the alternate sweeping and linear movement of the nozzle across the work surface.

Another object of this invention is to provide an apparatus for cleaning a work surface by blasting the surface with an abrasive wherein the apparatus comprises a cart mounted on plural wheels which wheels are adjustable for positioning between beams of a vessel or building structure.

Another object of this invention is to provide an apparatus for cleaning a work surface by blasting the surface with an abrasive including an improved adjustable nozzle support for supporting a plurality of nozzles in a substantially parallel array wherein the stacking of the plurality of nozzles may be varied within the parallel array to vary the blast pattern of the apparatus.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment of the invention being shown in the attached drawings and explained in the detailed discussion. For the purpose of summarizing the invention, the invention may be incorporated into an apparatus for cleaning a work surface by blasting the surface with an abrasive under fluid pressure from a remote source of abrasive and fluid. The apparatus comprises a base and at least one nozzle supported by a nozzle support. A conduit means connects the nozzle to the remote source of abrasive and fluid. Means are provided for rotatably mounting the nozzle support to the base about a first axis of rotation. Means are provided for rotatably mounting the nozzle support about a second axis of rotation for controlling the reaction force produced by the nozzle during operation. The first axis is established at an angle relative to the second axis such that rotation of the nozzle in a first direction about the second axis directs the reaction force of the nozzle during operation thereof to cause a first rotation of the nozzle about the first axis. Rotation of the nozzle in a second direction about a second axis directs the reaction force of the nozzle during operation thereof to cause a second rotation of the nozzle about the first axis. Actuator means is provided for alternately rotating the nozzle support about the second axis when the nozzle support rotates to predetermined terminal positions about the first axis enabling automatic alternate sweeping across the work surface.

In a more specific form of the invention, the actuator comprises a pneumatic actuator for rotating the nozzle about the second axis. A first sensor means senses the position of the nozzle support about the first axis. The first sensor is connected to the actuator for controlling rotation of the nozzle support about the second axis when the nozzle support is disposed in one of the preselected terminal positions. The first sensors may be adjusted for adjusting the sweep across the work surface. Means may be provided for retarding the movement of the nozzle support about the first axis. The retarding means includes a hydraulic piston and cylinder with a hydraulic valve regulating the flow of hydraulic fluid relative to the hydraulic cylinder.

In another embodiment of the invention, the apparatus includes a movable base or a cart having a plurality of wheels for enabling linear movement of the base relative to the work surface. Base drive means is provided for linearly moving the base relative to the work surface. A control is connected to the base drive and the actuator for controlling the movement of the apparatus enabling controlled sweeping and linear movement of the nozzle across the work surface. In one embodiment of the apparatus, the cart comprises a first and a second axle with each of the axles having a wheel on each terminal end thereof. Means are provided for adjusting the spacing between the wheels on each of the terminal ends of the first and second axles allowing the device to be operated between upstanding beams or the like. The apparatus may also include means for rotatably mounting a nozzle support about a third axis disposed perpendicular to one of the first and second axes, thereby controlling the distance between the nozzle and the work surface. The rotation about the third axis may be preferably locked into a position upon making proper adjustment.

In a specific example of the invention, first and second sensor means sense the rotational position of the nozzle support about the first and second axes, respectively. A third sensor means senses the movement of the base relative to the work surface by the base drive means. A control is connected to the sensor means for controlling the actuator and a base drive means for coordinating the alternate sweeping and linear movement across the work surface. The control energizes the retarding means to lock the movement of the nozzle support about the first axis when the nozzle support is disposed in a terminal rotational position about the first axis. Thereafter, the control means activates the actuator to rotate the nozzle support about the second axis when the nozzle support is locked on the first axis. The base drive is then activated to move the base a preestablished distance along the work surface. The control deactivates the base drive and unlocks the retarding means upon a predetermined linear movement of the base relative to the work surface. The apparatus may be operated in a merely supervisory manner while the apparatus cleans a rectangular work surface having a width equal to the sweep of the nozzle support and a length equal to the linear displacement by the base drive means.

The invention may also be incorporated into an apparatus for cleaning a work surface by blasting the surface with an abrasive under fluid pressure from a remote pressure source of abrasive and fluid. In this embodiment, the apparatus comprises a plurality of nozzles with conduit means connecting the plurality of nozzles to the remote source of abrasive and fluid. Adjustable nozzle support means supports the plurality of nozzles in a substantially parallel array. The adjustable nozzle support means enables adjustment of the relative position of the plurality of nozzles within the parallel array for varying the blasting pattern of the plurality of nozzles. The adjustable nozzle support adjusts the stacking of the plurality of nozzles in the parallel array. More specifically, the adjustable nozzle support includes a first and a second support surface for receiving the plurality of nozzles therebetween. Means are provided for adjusting the relative distance between the first and second support surfaces for varying the position of the plurality of nozzles within the parallel array. The first and second support surfaces may be substantially parallel with third and fourth support surfaces extending perpendicularly to the first and second support surfaces. Accordingly, the dimensions of the rectantular area formed by the support surfaces adjust the array of plurality of nozzles therein. In a specific example of the invention, the first and second support surface are support plates whereas the third and fourth support surfaces are fastening means extending through apertures within the first and second support plates.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Other objects and a fuller understanding of this invention may be had by referring to the summary of the invention, the description and the claims taken in conjunction with the accompanying drawings.

DETAILED DESCRIPTION

Figure 1:
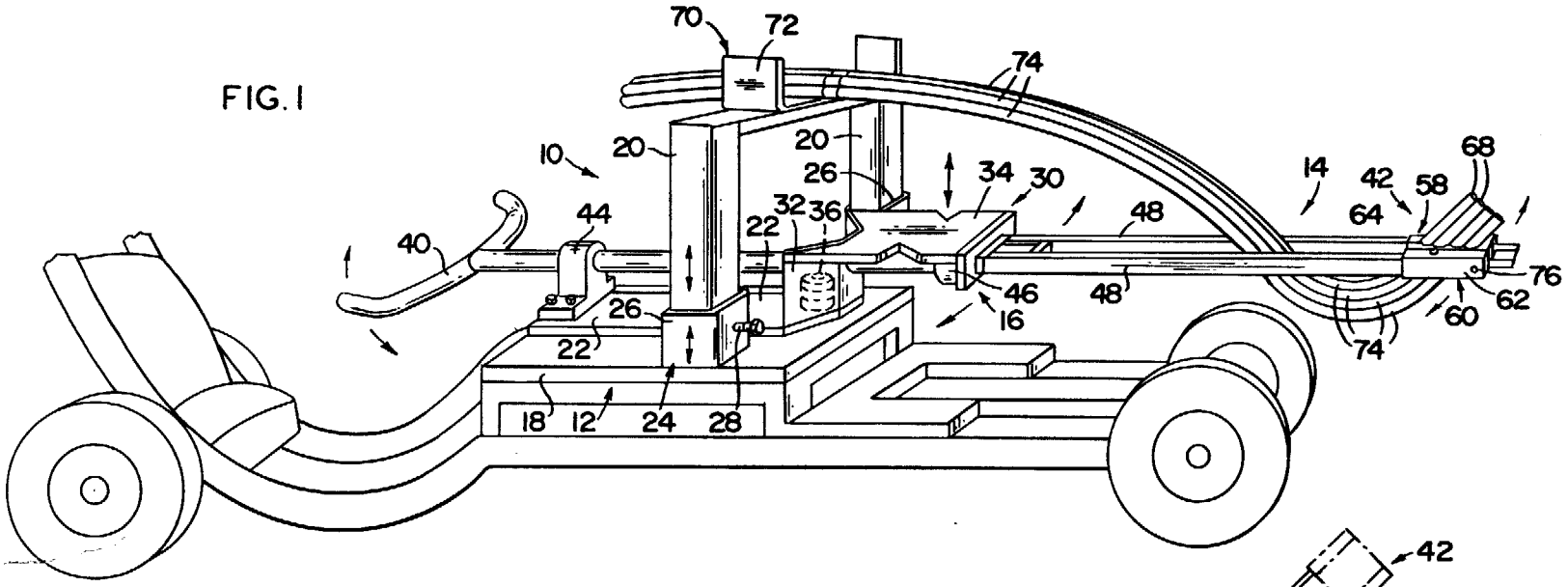
FIG. 1 is a perspective view of a first embodiment of an abrasive cleaning apparatus.
Figure 2:
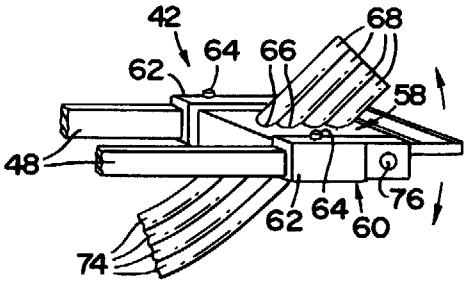
FIG. 2 is a detailed view of a nozzle holder.
Figure 3:
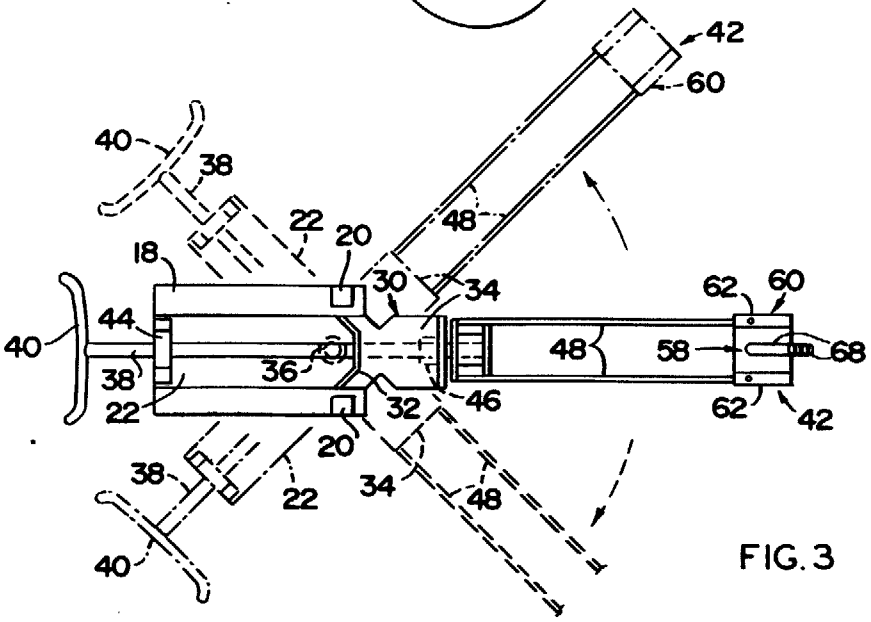
FIG. 3 is a partial top view of the apparatus of FIG. 1 with the conduit means and conduit support removed to more clearly illustrate the apparatus.

As best shown in FIG. 1, the present invention comprises an abrasive cleaning apparatus generally indicated as 10 for cleaning large work surfaces. In particular, the abrasive cleaning apparatus 10 is exceptionally useful for cleaning the undersides and decks of ships in dry dock by the positioning of a plurality of nozzles in operative communication therewith. The abrasive cleaning apparatus 10 comprises a base means 12, an adjustable nozzle support means 14 and an interconnecting support means 16 adjustably attached at one end thereof to the base means 12 and fixedly attached at the opposite end thereof to the adjustable nozzle support means 14.

The base means 12 comprises a base plate 18 to attach the abrasive cleaning apparatus 10 to the platform of a mobile chassis such as a golf cart or forklift or the like. The base means 12 includes a pair of vertical risers 20 which are substantially parallel members fixedly attached at the lower portions thereof to the base plate 18. Since the height between the hull of a ship and the floor of a dry dock is sometimes no more than three or four feet, the combined height of the mobile chassis and the vertical risers 20 must be small enough so the abrasive cleaning apparatus 10 can be maneuvered under a ship for cleaning purposes.

The interconnecting support means 16 comprises a substantially flat support plate 22 and a pair of riser attachment means 24 which adjustably and fixedly attach the support plate 22 to the pair of vertical risers 20. Each riser attachment means 24 comprises a collar 26 fixedly attached to the support plate 22 and a bolt 28 or other attachment means to fixedly attach the collar 26 to the vertical riser 20. Thus the height of the nozzle support means 14 can be adjusted by affixing the collars 26 to the pair of vertical risers 20 at the desired height. The vertical risers 20 and the riser attachment means 24 cooperatively comprise a vertical adjustment means.

The interconnecting support means 16 further comprises at least one support member 30 including a first vertical element 32 attached to support plate 22 and a second horizontal element 34. An attachment shaft 36 is rotatably coupled to the support plate 22 by means of a bearing (not shown) to the base means 12 to permit horizontal rotation of the adjustable nozzle support means 14 about a first or vertical axis of the attachment shaft 36 as more fully described hereinafter.

The adjustable nozzle support means 14 comprises a rotatable support shaft 38 with a rotation means 40 such as a wheel or yoke fixedly attached at one end thereof and a nozzle holder 42 fixedly attached at the opposite end thereof. A first and second bearing means 44 and 46 respectively are attached to the support plate 22 and horizontal element 34 respectively to rotatably mount the support shaft 38 about a second axis.

The nozzle holder 42 comprises a pair of substantially parallel support members 48 fixedly attached to the support shaft 38. A nozzle collar 58 is pivotally attached to a pair of substantially parallel attachment means 60. Each attachment means 60 comprises an attachment member 62 removably attached to the outer portion of one of the support members 48 by fastening means 64. It should be understood that the nozzle collar 58 may be directly attached to the support shaft 38.

The nozzle collar 58 has a plurality of apertures 66 formed therein which operatively support a plurality of nozzles 68 disposed at an angle relative to shaft 38. A conduit plate 70 having a U-shaped conduit retainer 72 formed thereon is attached to risers 20 to operatively support a plurality of conduit means 74 connected to the plurality of nozzles 68.

The plurality of nozzles 68 are coupled to a remote supply source (not shown) through the conduit means 74 such as hoses. For example, the remote supply source may comprise a sand hopper and a source of compressed air. Compressed air propels the abrasive such as sand along flexible sand conduits whereas a separate supply of compressed air is directed along flexible air conduits. The separate supply of compressed air is directed into mixing reservoir within the blast nozzles 68 to impinge the sand against the work surface. The manner in which the air and sand is mixed in the nozzle is of no particular concern. The nozzle structure 68 of the present mechanism itself can be of any appropriate conventional configuration.

As is readily understood, the sand or abrasive must leave the tips of the nozzles 68 with sufficient force to clean the work surface. For this force there is an equal force acting in the opposite direction. This equal and opposite force, commonly referred to as jet action, has a vertical vector or component, a horizontal vector or component parallel to the support shaft 38, and a horizontal vector or component perpendicular to the support shaft 38, acting on the nozzle support means 14. Since the nozzle support means 14 is rotatable about the second axis, the horizontal reaction force component perpendicular to the support shaft 38 will rotate the nozzle support means 14 about the first axis of attached shaft 36. When the nozzles 68 are positioned so that the horizontal component perpendicular to the support shaft 38 is zero, then the nozzle support means 14 will not rotate about the first axis of the attachment shaft 36.

The horizontal component of the force perpendicular to the support shaft 38 can be varied from zero to a large component of the total force by an operator rotating the rotation means 40 about the second axis. Thus neither brute strength nor elaborate electrical or other drive means but merely the jet action of the nozzles is needed to position the nozzles 68 about the first axis. The rotational speed about the first axis is determined by the magnitude of rotation about the second axis. The vertical riser 20 also serves to limit the horizontal movement of the nozzle support means 14 on either side by the engagement therewith.

The support shaft 38, rotation means 40 and the nozzle jet action comprise a horizontal positioning means for the positioning of the nozzles 68 in a plane substantially parallel to the work surface. The vertical adjustment means is adjusted prior to the cleaning operation to compensate for various heights of the hulls of ships from the floor of a dry dock or otherwise.

The nozzle collar 58 is pivotally attached to the pair of parallel support members 48 on shaft 76. This angular adjustment means adjusts the angle of the blast striking the work surface enabling the apparatus to clean surfaces of curvature on ship bottoms as well as flat areas with a high degree of efficiency.

The operator first adjusts the vertical risers 20 to position the nozzles 68 to be the most efficient distance for cleaning the work surface. The operator then adjusts the angular adjustment means to obtain the most efficient angular relationship of the nozzle 68 relative to the work surface. The abrasive cleaning apparatus 10 is then positioned by means of the mobile chassis to begin cleaning the work surface. The nozzles 68 are swept across the work surface by the operator turning the rotating means 40. The mobile chassis is intermittently moved to an adjacent work surface until the entire area is cleaned.

Figure 4:
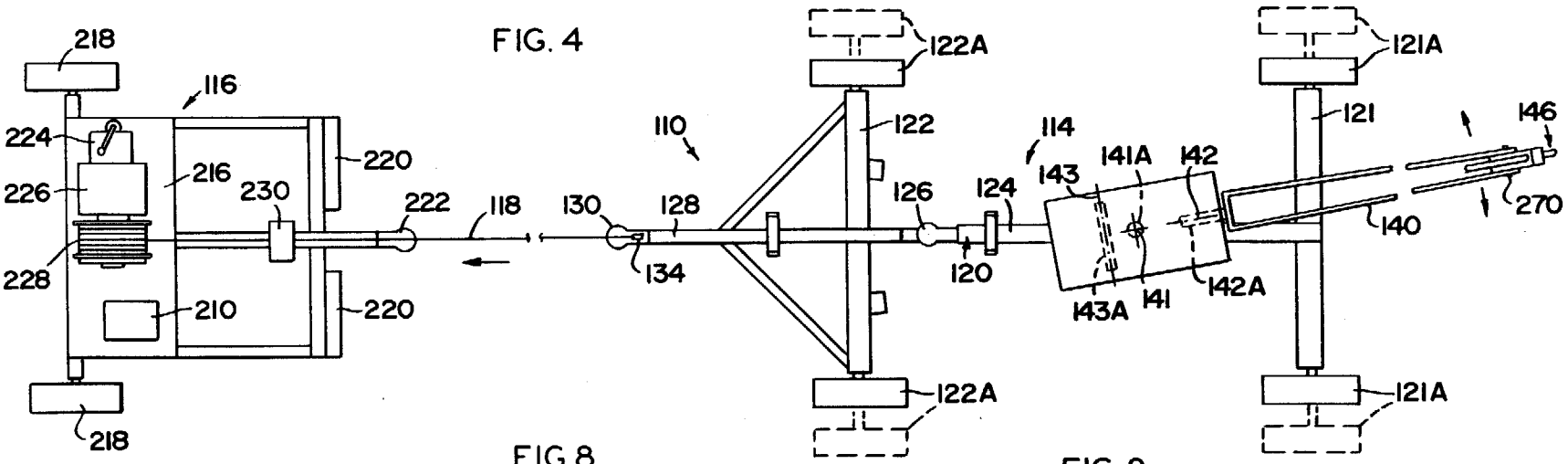
FIG. 4 is a planned view of a second embodiment of the invention and an improvement of the invention shown in FIGS. 1-3.
Figure 5:
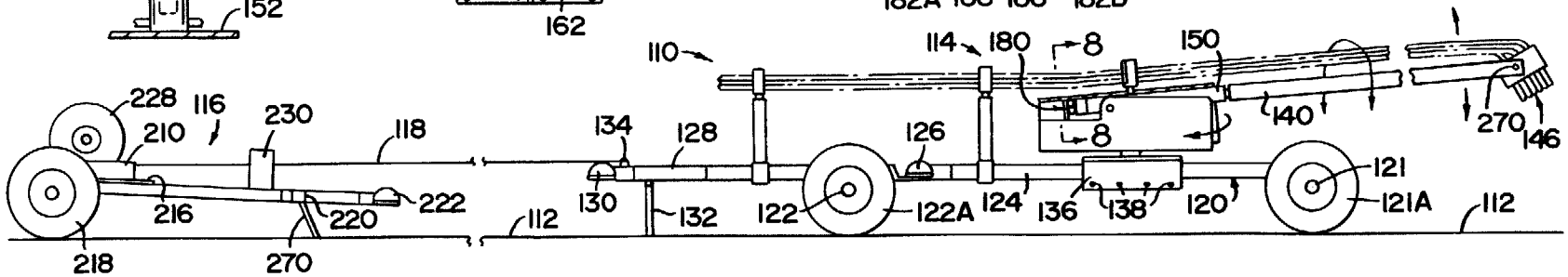
FIG. 5 is a side elevational view of FIG. 4.

FIGS. 4–16 illustrate various views of a second embodiment of the invention comprising an abrasive cleaning apparatus 110 for cleaning a work surface 112 shown in FIG. 5 with an abrasive under fluid pressure from a remote source of abrasive and fluid (not shown). The apparatus 110 comprises an abrasive cleaning unit 114 and a base drive means 116 interconnected by a winch cable 118. The abrasive cleaning unit 114 comprises a cart 120 having a first and a second axle 121 and 122 with wheels 121A and 122A disposed at the terminal ends of axles 121 and 122. The axles 121 and 122 are adjustable for varying the relative position of the wheels on the terminal end of each axle as shown in phantom in FIG. 5.

A cart frame 124 interconnects the first and second axles 121 and 122 through a ball hitch 126 enabling the first axle 121 to pivot independently of the second axle 122. The cart 120 may also be towed by a vehicle from hitch 126. The second axle 122 includes a tongue 128 having a hitch 130 for towing the entire cleaning unit 114 behind a vehicle. A support 132 positions tongue 128 at a suitable distance from the work surface 112. A winch cable connector 134 secures winch cable 118 to tongue 128 for moving the cleaning unit 114 upon movement of winch cable 118.

Figure 6:
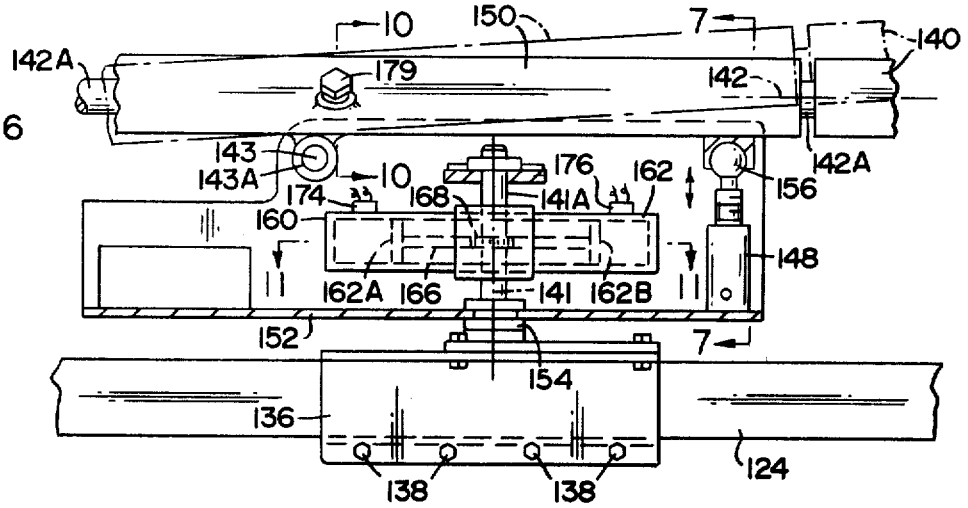
FIG. 6 is an enlarged partial view of FIG. 5 illustrating a first axis of rotation.

A base 136 is slidably mounted on cart frame 124 and may be locked in position by tightening bolts 138 as shown more clearly in FIG. 6. A first shaft 141A rotatably mounts a nozzle support 140 relative to base 136 about a first axis 141. A second shaft 142A rotatably mounts the nozzle support 140 relative to base 136 about a second axis 142. The first and second axes 141 and 142 are established at an angle relative to one another. A third shaft 143A rotatably mounts the nozzle support 140 relative to base 136 about a third axis 143 to position nozzle means 146 relative to the work surface 112. The arrows shown in FIG. 5 in addition to the phantom position in FIG. 6 illustrate the rotations about the axes 141–143.

Figure 7:
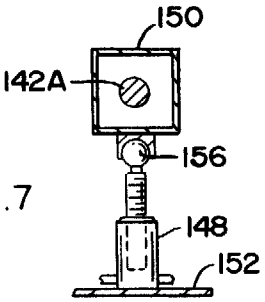
FIG. 7 is a sectional view along line 7—7 of FIG. 6.

The position of the nozzle support 140 about third axis 143 is established by a screw jack 148 shown more clearly in FIG. 7. A support 150 is pivotably mounted about third axis 143 relative to a plate 152 which is journalled by bearings 154 on shaft 141A extending from base 136. The screw jack 148 is secured to plate 152 and is coupled to the support 150 by a ball and socket joint 156 to adjustably lock the angle between support 150 and plate 152 against the reaction force produced by the nozzle means 146.

Figure 11:
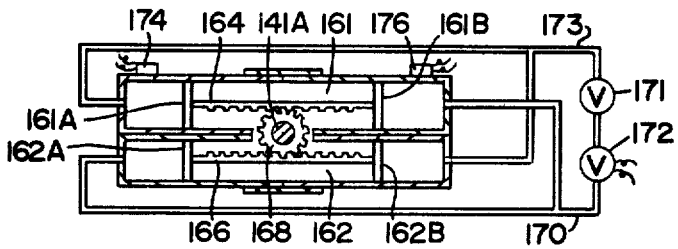
FIG. 11 is a sectional view along line 11—11 of FIG. 6 showing the internal configuration of the retarding means of the present invention.

Shaft 141A extends through retarding means 160, a sectional view thereof being shown in FIG. 11. The retarding means 160 provides a resistance to the movement of nozzle support 140 about the first axis 141 by the jet action of the nozzle means 146. The retarding means comprises plural cyclinders 161 and 162 connected in a hydraulic system which is shown schematically in FIG. 11. The first cylinder 161 comprises plural pistons 161A and 161B interconnected by a rack 164 engaging a pinion gear 168. In a similar fashion, a second cylinder 162 comprises pistons 162A and 162B interconnected by a rack 166 engaging pinion gear 168. Pinion gear 168 is secured to shaft 141A. Accordingly, rotation of the nozzle support 140 in a counterclockwise direction in FIG. 4, results in pistons 161B and 162A expelling hydraulic fluid from conduit 170 through valves 171 and 172 to conduit 173 to return to the opposite ends at cylinders 161 and 162. A clockwise rotation of nozzle support 140 in FIG. 4 results in pistons 161A and 162B expelling hydraulic fluid from conduit 173 through valves 171 and 172 to conduit 170. Valve 171 regulates the fluid flow through valve 171 independent of the applied hydraulic pressure. Manual adjustment of valve 171 controls the velocity of rotation of nozzle support 140 about the first axis 141. Valve 172 is an electrically operated shut off valve for locking the nozzle support about the first axis 141. Pistons 161A and 161B may be magnetized enabling reed switches 174 and 176 to sense the position of the nozzle support 140 about the first axis 141.

The nozzle support 140 is journalled by the second shaft 142A within the support 150 by suitable bearing means (not shown). A projection 177 shown in FIG. 10 extends from shaft 142A within the support 150 for movement between stops 178 and 179 threadably extending through bosses in the support 150. Adjustment of stops 178 and 179 vary the amount of rotation of nozzle support 140 about the second axis 142.

Figure 9:
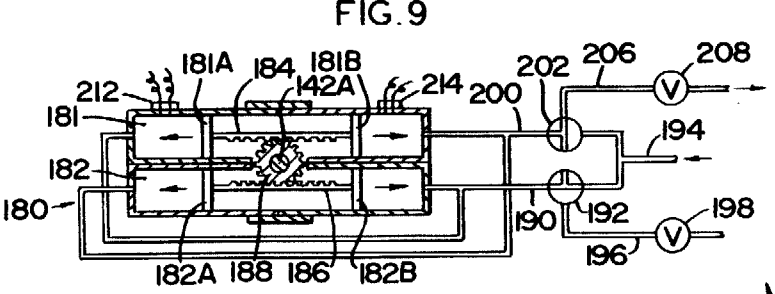
FIG. 9 shows the internal configuration of the actuator shown in FIG. 8.
Figure 8:
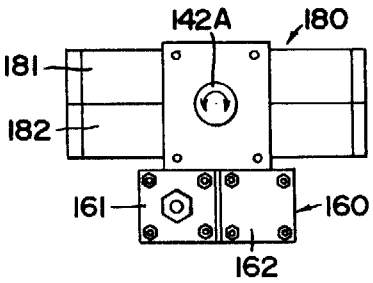
FIG. 8 is a partial elevational view taken along line 8—8 in FIG. 5.

FIG. 8 is a rear elevational view along line 8—8 in FIG. 5 illustrating actuator means 180 for rotating shaft 142A about the second axis 142. The retarding means 160 including cylinders 161 and 162 is also shown in FIG. 8. The internal configuration of the actuator means 180 is shown in FIG. 9 comprising a first and a second air cylinder 181 and 182. The first cylinder 181 comprises pistons 181A and 181B interconnected by a rack 184 engageable with a pinion gear 188 secured to second shaft 142A. In a similar manner, the second cylinder 182 comprises pistons 182A and 182B interconnected by a rack 186 engageable with pinion gear 188. The portions of cylinders 181 and 182 adjacent pistons 181A and 182B are connected by a conduit 190 to a dual position valve 192 which may communicate with an air input conduit 194 or in the alternative communicate through a conduit 196 to a flow valve 198. In a similar manner, the portions of cylinders adjacent pistons 182A and 181B are connected through a conduit 200 to a dual position valve 202 which communicates wih either input conduit 194 or a conduit 206 communicating with a flow valve 208. The dual position valves 192 and 202 are ganged as indicated by the dashed line to operate as a single unit. The flow valves 198 and 208 enable a constant volume of air or air flow rate to pass therethrough independent of the applied pressure. The flow valves 198 and 208 may be manually adjusted for controlling the airflow therethrough. The position of valves 192 and 202 are controlled by control means 210 located on the base drive means 116. Second sensors shown as reed switches 212 and 214 sense the magnetic presence of pistons 181A and 181B to indicate the rotational position of second shaft 142A.

When the valves 192 and 202 are positioned as indicated, compressed air entering conduit 194 creates a clockwise rotation of shaft 142A and nozzle support 140 to control the reaction force of the nozzle means 146. Air exiting through conduit 200 flows through flow valve 208 thereby controlling the rate of rotation of shaft 142A in accordance with the manual setting of valve 208. When valves 192 and 202 are placed in the opposite position as shown, air entering conduit 194 is directed through conduit 200 to cause a counterclockwise rotation of shaft 142A as viewed in FIG. 9. Air exiting from conduit 190 is directed through conduit 196 to flow valve 198. The manual adjustment of valve 198 controls the rotational rate of shaft 142 in the counterclockwise direction.

FIGS. 4 and 5 illustrate in more detail the base drive means as comprising a movable platform 216 having wheels 218 and a brake 220 shown as a depending stop. A hitch 222 is provided for towing the base drive means 116 behind a vehicle. The base drive means comprises a winch assembly including an air motor 224 connected through a gear box 226 to a winch drum 228 for receiving the winch cable 118. A third sensor means 230 senses the movement of cable 118 relative to the base drive means 116. The first sensor means comprising reeds switches 174 and 176 of FIG. 11, the second sensor means comprising reed switches 212 and 214 of FIG. 9 in addition to the third sensor means 230 are connected to the control means 210 located on the base driving means 116. Of course it should be understood that the control means 210 may be mounted on the abrasive cleaning unit 114 and/or may be remotely located from both the abrasive cleaning unit 114 and the base drive means 116. Valves 172 of FIG. 11 and 192 and 202 of FIG. 9 as well as the control of air motor 224 and gear box 226 are likewise connected to the control means 210.

The control means 210 coordinates the sweeping motion of the nozzle support 140 and the linear advancement of the abrasive cleaning unit 114 by the winch cable 118. A preferred sequence of operation results in the nozzle means 146 being positioned in one of the rotational terminal positions on the second axis 142. The reaction force caused by the nozzle means 146 during operation causes a rotation of the nozzle support 140 about the first axis 141. Upon reaching a terminal position as sensed by one of the reed switches 174 or 176, the control means 210 closes valve 172 thereby locking the position of nozzle support 140 about the first axis 141. Thereafter, valves 192 and 202 are properly positioned and air is allowed to enter conduit 194 thereby rotating the nozzle support 140 about the second axis 142. The completion of rotation about the second axis 142 is sensed by reed switches 212 and 214 enabling the control 210 to activate winch air motor 224 to linearly displace the abrasive cleaning unit 114 relative to the work surface 112. Third sensor 230 measures the displacement of abrasive cleaning unit 214 relative to the work surface 112 to terminate power to air motor 224 upon proper movement of the cleaning unit 114. The control means 210 then deactivates the valve 172 enabling the nozzle support 140 to rotate about the first axis by the reaction force of nozzle means 146. It should be appreciated that the sequence can continue for both left and right terminal positions of the nozzle support 140 as seen in FIG. 4. The control means enables the manual override of all automatic sequences set forth herein. The apparatus 110 is capable of cleaning a rectangular area having a width substantially equal to the sweep of nozzle means 146 and a length equal to the linear displacement of the cleaning unit 114 by the base drive means 116. It should be appreciated that the sensing means set forth herein are specific examples but numerous other sensing and actuating devices may be utilized within the scope of the invention.

Figure 12:
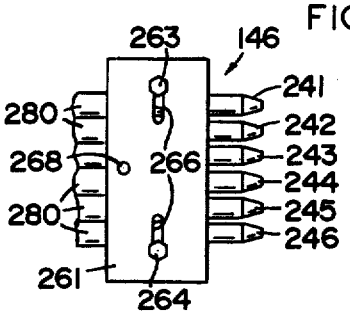
FIG. 12 is a side elevational view of an adjustable nozzle support for the invention shown in FIGS. 4 and 5.
Figure 14:
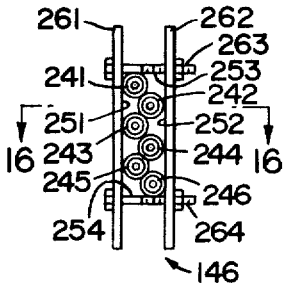
FIG. 14 shows an adjustment of the array of nozzles of FIGS. 12 and 13.
Figure 13:
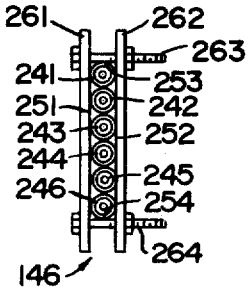
FIG. 13 is a front view of the adjustable nozzle support shown in FIG. 12.
Figure 15:
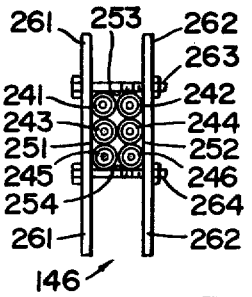
FIG. 15 shows a further adjustment of the array of nozzles of FIGS. 12 and 13.

FIGS. 12–16 illustrate various views of the nozzle means 146 shown in FIGS. 4 and 5. The nozzle means in this embodiment supports a plurality of nozzles 241–246 in a substantially parallel array. An adjustable nozzle support comprises a first and a second substantially parallel support surface 251 and 252. A third and a fourth support surface 253 and 254 are established substantially perpendicular to the first and second surfaces 251 and 252 forming a substantially rectangular area for receiving the plurality of nozzles 241–246 therein. The first and second support surfaces are shown as support plates 261 and 262 each having aperture means therethrough shown as slots 266. The third and fourth support surfaces 253 and 254 are shown as threaded fasteners or bolts 263 and 264 slidably received in slots 266. FIGS. 12 and 13 illustrate a first arrangement of nozzles 241–246 wherein the nozzles form a single row with the threaded fasteners 263 and 264 in the outermost regions of slots 266. FIG. 15 shows the arrangement of nozzles 241–246 forming two substantially parallel rows. In this embodiment, the threaded fasteners 263 and 264 are at a minimal spacial distance in slots 266. FIG. 14 illustrates an intermediate parallel arrangement or stacking of the nozzles 241–246 between FIGS. 13 and 15. It should be understood that an infinite number of arrangements may be had between the arrangements shown in FIGS. 13 and 15. The instant invention enables the blast pattern of the nozzle means 146 to be varied by varying the stacking or array of the parallel nozzles 241–246. Accordingly, the nozzle blast pattern may be varied to meet a particular need of the sand blasting task. The plates 261 and 262 each have an aperture 268 for pivoting on a pivot 270 as shown in FIGS. 4 and 5.

Figure 16:
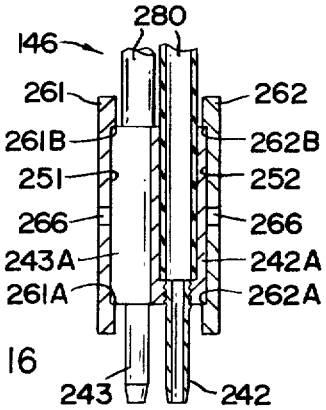
FIG. 16 is a sectional view along line 16—16 of FIG. 14.
Figure 10:
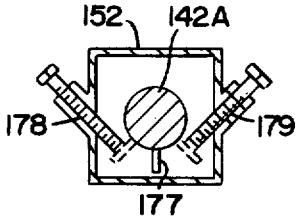
FIG. 10 is a sectional view along line 10—10 of FIG. 6.

FIG. 16 is an enlarged sectional view along line 16–16 of FIG. 14 showing in greater detail the plates 261 and 262. Each of the plates has a front shoulder 261A and 262A and a rear shoulder 261A and 262B for positioning nozzle collars 242A and 243A therebetween. The nozzle collar 242A is shown in section as threadably receiving nozzle 242 in one end thereof and a flexible hose 280 in the other end thereof. The shoulders 261A, 262A, 261B and 262B insure that the nozzle 241–246 are properly held within the nozzle means 146. Although the disclosed embodiment of FIGS. 12–16 shows the use of four support surfaces, it should be understood that three or more support surfaces may be utilized for creating the plural nozzle array. In addition, the nozzle array may be contained within an area defined by a polygon, a circle or other configurations depending on the desired blast pattern.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

The invention claimed is:

1. An apparatus for cleaning a work surface by blasting the surface with an abrasive under fluid pressure from a remote control source of abrasive and fluid, comprising in combination:

a base;

a least one nozzle;

a nozzle support for supporting said nozzle;

conduit means connecting said nozzle to the remote source of abrasive and fluid;

means for rotatably mounting said nozzle support to said base about a first axis of rotation;

means for rotatably mounting said nozzle support about a second axis of rotation for directing the reaction force produced by said nozzle during operation;

means establishing said second axis to form an angle relative to said first axis such that rotation of said nozzle in a first direction about said second axis directs the reaction force of said nozzle during operation thereof to cause a drive force of said nozzle in a first direction about said first axis;

rotation of said nozzle in a second direction about said second axis directs the reaction force of said nozzle during operation thereof to cause a rotation drive force of said nozzle in a second direction about said first axis; and actuator means for alternately reversing rotation of said nozzle support about said second axis between said opposite drive force directions as a function of said nozzle support rotating to predetermined terminal positions about said first axis, whereby said nozzle support is driven in sweeping strokes across the work surface.

2. An apparatus as set forth in claim 1, wherein said actuator means comprises a pneumatic actuator for rotating said nozzle support about said second axis.

3. An apparatus as set forth in claim 1, including sensor means for sensing the position of said nozzle support about said first axis; and means connecting said sensor to said actuator means for activating rotation of said nozzle support upon said second axis when said nozzle support is disposed in one of said terminal positions.

4. An apparatus as set forth in claim 3, including means for adjusting said sensor means for establishing a selected sweep width across the work surface.

5. An apparatus for cleaning a work surface by blasting the surface with an abrasive under fluid pressure from a remote source of abrasive and fluid, comprising in combination:

a base;

at least one nozzle;

a nozzle support for supporting said nozzle;

conduit means connecting said nozzle to the remote source of abrasive and fluid;

means for rotatably mounting said nozzle support to said base about a first axis of rotation;

means for rotatably mounting said nozzle support about a second axis of rotation for controlling the reaction force produced by said nozzle during operation;

means establishing said second axis to form an angle relative to said first axis such that rotation of said nozzle in a first direction about said second axis directs the reaction force of said nozzle during operation thereof to cause a first rotation of said nozzle about said first axis;

rotation of said nozzle in a second direction about said second axis directs the reaction force of said nozzle during operation thereof to cause a first rotation of said nozzle about said first axis;

actuator means for alternately rotating said nozzle support about said second axis upon said nozzle support rotating to a predetermined terminal position about said first axis enabling automatic alternating sweeping across the work surface; and means for applying a selected and adjustable threshhold resistance to rotation of said nozzle support, whereby the sweep of the nozzle support is brought to a controlled and selectable terminal reverse position.

6. An apparatus as set forth in claim 5, wherein said means for applying a selected and adjustable threshhold resistance comprises hydraulic piston and cylinder means; and hydraulic valve means establishing the maximum rate of flow of hydraulic fluid relative to said hydraulic cylinder means.

7. An apparatus for cleaning a work surface by blasting the surface with an abrasive under fluid pressure from a remote source of abrasive and fluid, comprising in combination:

a base;

at least one nozzle;

a nozzle support for supporting said nozzle;

conduit means connecting said nozzle to the remote source of abrasive and fluid;

means for rotatably mounting said nozzle support to said first base about a first axis of rotation;

means for rotatably mounting said nozzle support about a second axis of rotation for controlling the reaction force produced by said nozzle during operation;

means establishing said second axis to form an angle relative to said first axis such that rotation of said nozzle in a first direction about said second axis directs the reaction force of said nozzle during operation thereof to cause a first rotation of said nozzle about said first axis and rotation of said nozzle in a second direction about said second axis directs the reaction force of said nozzle during operation thereof to cause a second rotation of said nozzle about said first axis whereby alternate rotation about said second axis produces alternating sweeping across the work surface;

actuator means for alternately reversing rotation of said nozzles about said second axis between opposite drive force directions as a function of said nozzle support rotating to predetermined terminal positions about said first axis, whereby said nozzle support is driven in alternating sweeping strokes across the work surface;

base drive means for linearly moving said base relative to the work surface; and control means for controlling said actuator means and said base drive means enabling controlled sweeping and linear movement of said nozzle across the work surface.

8. An apparatus as set forth in claim 7, wherein said base drive means includes means for intermittently moving said base a predetermined linear distance between alternate rotations of said nozzle about said first axis.

9. An apparatus as set forth in claim 7, wherein said base drive means includes a winch having a winch cable connected to said base; and means for measuring the linear displacement of said base relative to the work surface.

10. An apparatus for cleaning a work surface by blasting the surface with an abrasive under fluid pressure from a remote source of abrasive and fluid, comprising in combination:

a base;

at least one nozzle;

a nozzle support for supporting said nozzle;

conduit means connecting said nozzle to the remote source of abrasive and fluid;

means for rotatably mounting said nozzle support to said base about a first axis of rotation;

means for rotatably mounting said nozzle support about a second axis of rotation for controlling the reaction force produced by said nozzle during operation;

means establishing said first axis to form an angle relative to said second axis such tht rotation of said nozzle in a first direction about said second axis directs the reaction force of said nozzle during operation thereof to cause a first rotation of said nozzle about said first axis and rotation of said nozzle in a second direction about said second axis directs the reaction force of said nozzle during operation thereof to cause a second rotation of said nozzle about said first axis whereby alternate rotation about said second axis produces alternating sweeping across the work surface; and means for rotatably mounting said nozzle support about a third axis disposed perpendicular to one of said first and second axes for controlling the distance between said nozzle and the work surface.

11. An apparatus as set forth in claim 10, including means for locking the position of said nozzle support about said third axis.

12. An apparatus for cleaning a work surface by blasting the surface with an abrasive under fluid pressure from a remote source of abrasive and fluid, comprising in combination:

a base;

at least one nozzle;

a nozzle support for supporting said nozzle;

conduit means connecting said nozzle to the remote source of abrasive and fluid;

means for rotatably mounting said nozzle support to said base about a first axis of rotation;

means for rotatably mounting said nozzle support about a second axis of rotation for controlling the reaction force produced by said nozzle during operation;

means establishing said first axis to form an angle relative to said second axis such that rotation of said nozzle in a first direction about said second axis directs the reaction force of said nozzle during operation thereof to cause a first rotation of said nozzle about said first axis and rotation of said nozzle in a second direction about said second axis directs the reaction force of said nozzle during operation thereof to cause a second rotation of said nozzle about said first axis;

first sensor means for sensing the rotational position of said nozzle support about said first axis;

second sensor means for sensing the rotational position of said nozzle support about said second axis;

actuator means for alternately rotating said nozzle support about said second axis;

retarding means for retarding the movement of said nozzle support about said first axis;

base drive means for linearly moving said base relative to the work surface;

third sensor means for sensing the movement of said base by said base drive means;

control means connected to said sensor means for controlling said actuator means and said base drive means and said retarding means for alternately rotating said nozzle support about said second axis upon said nozzle support being disposed in terminal rotational positions about said first axis; and said control means activating said base drive means for coordinating said alternating sweeping and said linear movement across the work surface.

13. An apparatus as set forth in claim 12, wherein said control means energizes said retarding means to lock the movement of said nozzle support about said first axis upon said nozzle support being disposed in one of said terminal rotational portions.

14. An apparatus as set forth in claim 13, wherein said control means activates said actuator to rotate said nozzle support about said second axis upon said nozzle support being locked in one of said terminal rotational positions.

15. An apparatusas set forth in claim 14, wherein said control means activates said base drive means upon the completion of rotation of said nozzle support about said second axis.

16. An apparatus as set forth in claim 15, wherein said control means deactivates said base drive means and unlocks said retarding means upon a predetermined linear movement of said base relative to the work surface.

17. An apparatus for cleaning a work surface by blasting the surface with an abrasive under fluid pressure from a remote source of abrasive and fluid, comprising in combination:

a plurality of nozzles;

conduit means connecting aid plurality of nozzles to the remote source of abrasive and fluid;

adjustable nozzle support means for supporting said plurality of nozzles in a substantially parallel array and for adjusting the stacking of said plurality of nozzles in said parallel array;

said adjustable nozzle support means enabling adjustment of the relative position of said plurality of nozzles within said parallel array for varying the biasing pattern of said plurality of nozzles.

18. An apparatus as set forth in claim 17, wherein said adjustable nozzle support means includes a first and a second support surface for receiving said plurality of nozzles therebetween; and means for adjusting the relative distance between said first and second support surfaces for varying the postion of said plurality of nozzles within said parallel array.

19. An apparatus as set forth in claim 18, wherein said first and second support surfaces are substantially parallel.

20. An apparatus as set forth in claim 19, including third and fourth support surfaces each extending perpendicularly to said first and second support surfaces; and means for adjusting the dimensions of the rectangular area formed by said support surfaces for adjusting the stacking of said plurality of nozzles disposed therein.

21. An apparatus as set forth in claim 20, wherein said first and second support surfaces are support plates; and said third and fourth support surfaces are fastening means extending through apertures in said first and second support plates.

22. An apparatus for cleaning a work surface by blasting the surface with an abrasive under fluid pressure from a remote source of abrasive and fluid, comprising in combination:

a plurality of nozzles;

conduit means connecting said plurality of nozzles to the remote source of abrasive and fluid;

adjustable nozzle support means for supporting said plurality of nozzles in a substantially parallel array;

said adjustable nozzle support means comprising a plurality of support surfaces for supporting said plurality of nozzles within the perimeter formed by said support surfaces; and means for adjusting the relative spacing of said support surfaces for varying the relative position of said plurality of nozzles within said parallel array thereby varying the blasting pattern of the apparatus.

23. An apparatus as set forth in claim 22, wherein said plurality of support surfaces comprises at least two support plates.

24. An apparatus as set forth in claim 23, including aperture means extending through said support plates.

25. An apparatus as set forth in claim 24, wherein said plurality of support surfaces comprises at least two fastening members extending through said aperture means in said support plates.

* * * * *